United States Patent [19]

Brewer

[11] 4,350,308

[45] Sep. 21, 1982

[54] SHREDDING MACHINE AND COMPONENTS THEREOF

[75] Inventor: John C. Brewer, Salt Lake City, Utah

[73] Assignee: Garbalizer Corp. of America, Utah

[21] Appl. No.: 139,392

[22] Filed: Apr. 11, 1980

[51] Int. Cl.[3] ..... B02C 18/18

[52] U.S. Cl. ..... 241/294; 144/237; 241/243; 241/285 B; 407/31

[58] Field of Search ..... 241/73, 190, 243, 285 A, 241/285 B, 294, DIG. 31, DIG. 38; 407/31; 144/236, 237

[56] References Cited

U.S. PATENT DOCUMENTS

| | | | |
|---|---|---|---|
| 1,432,580 | 10/1922 | Vauclain et al. | 144/237 UX |
| 2,068,450 | 1/1937 | Eberly | 241/243 |
| 2,986,347 | 5/1961 | Stevenson | 241/190 X |
| 3,146,961 | 9/1964 | Putman, Jr. | 241/294 X |
| 3,823,633 | 7/1974 | Ross | 241/294 X |
| 4,000,860 | 1/1977 | Gotham | 241/294 X |
| 4,015,782 | 4/1977 | Granite | 241/243 X |
| 4,059,236 | 11/1977 | Brewer | 241/243 |
| 4,125,228 | 11/1978 | Brewer | 241/243 |
| 4,176,800 | 12/1979 | Brewer | 241/243 |
| 4,205,799 | 6/1980 | Brewer | 241/243 |

*Primary Examiner*—Howard N. Goldberg
*Attorney, Agent, or Firm*—M. Ralph Shaffer

[57] ABSTRACT

A shredder structure, components, and sub-combinations thereof, useful for shearing, shredding, and/or chopping a variety of materials such as municipal and industrial solid waste products, vehicle tires, and other materials desired to be comminuted. The hopper of the structure is preferably hinged to provide easy access to the made-up shaft. The shaft carries a series of rotating bladeholders keyed to the shaft and provided with radial protrusions and contiguous slots accommodating fitted-blade placement. The rotating bladeholders are spaced apart by spacers which serve not only to mutually space the rotating bladeholders, but also to support the sides of the rotating blades so as to form with the bladeholder slot pockets or seats for such blades. Particular support structure is used for the stationary blade employed, with which the individual rotating blades on each bladeholder co-act.

9 Claims, 15 Drawing Figures

SHREDDING MACHINE AND COMPONENTS THEREOF

FIELD OF INVENTION

This invention pertains to a shredder, shearing or chopping structure, and components and sub-combinations thereof, for the end use, by way of example, of comminuting rubber tires and municipal and/or industrial solid waste products.

RELATED APPLICATION

This application contains subject matter common to my earlier filed co-pending application No. 947,108 filed on Sept. 29, 1978, entitled, Shredding Apparatus, now U.S. Pat. No. 4,205,799, issued on June 3, 1980.

DESCRIPTION OF PRIOR ART

Certain patents are known, many of the same being the inventor's own patents, which relate to the shredder field. These are as follows: U.S. Pat. Nos. Eberly 2,068,450, Ross 3,823,633, Gotham 4,000,860, Brewer 4,059,236, Brewer 4,176,800.

The present invention distinguishes and also is an improvement in certain respects over the above disclosures in the provision of a shredder structure which is not only hinged and has unique blade support structure, but also which has blades so seated relative to the individual baldeholders employed and the spacers used as to provide unusually long-life for the shaft make-up and the individual blade segments themselves. Such make-up allows for the attachment of the individual movable blades to the bladeholders by simply a single capscrew or other attachment means; the inner sides of the movable blades are held against movement during blade-impact periods, not only by the slots in the bladeholders accommodating such blades, but also by the spacers overlapping such slots. Other structural advantages are found in the present invention which represent advances over the prior art in the nature of the support of the stationary blade, hopper-side design, screen support and inclusion, et cetera.

BRIEF DESCRIPTION OF THE INVENTION

The shredder structure herein incorporates a hopper the feed side of which is hinged in a manner such that the side can be pivoted away from the shaft so that the made-up shaft can be reworked as may be desired during downtime maintenance periods. That portion of the structure beneath the hinged side structure is made of a series of blocks or members that are dowel-pinned or otherwise secured together, for supplying a secure, preferably inclined support for the blade structure utilized relative to the stationary blade portion of the design. The rotor comprising the shaft having a series of movable bladeholders, provided with slots and contiguous projections accommodating individual mounted blades. The mounting of such blades is completed not only by threaded attachments, or other desired attachments, but also by the locking in the blades by virtue of the inclusion of spacers positioned in thrusting relationship with the sides of the individual bladeholders and their movable blades. Accordingly, side thrust on the blades is virtually eliminated, with wear being minimized. A composite screen and shell guide is employed which screens out properly cut pieces as well as permits the redirection of oversized pieces back for subsequent shredding.

OBJECTS

Accordingly, a principal object is to provide a new and improved shredder apparatus, and components and sub-combinations thereof.

An additional object is to provide a shredding, shearing and/or chopping apparatus.

A further object is to provide a shredder design suitable for accomplishing secondary shredding in an industrial process.

An additional object is to provide a structure suitable for comminuting vehicle tires.

An additional object is to provide shredding apparatus incorporating a made-up shaft provided with movable bladeholders and inter-blade-holder spacers, the spacers and holders defining pockets rigidly holding the rotating cutting blades of the rotor.

A further object is to provide a rotor in a shredding construction wherein the movable blades thereof are positively held against any substantial movement during impact.

An additional object is to provide a new and useful stationary cutter blade and cutter blade support design.

BRIEF DESCRIPTION OF DRAWINGS

The features of the present invention which are believed to be novel are set forth with particularity in the appended claims. The present invention, both as to its organization and manner of operation, together with further objects and advantages thereof may best be understood by reference to the following description, taken in connection with the accompanying drawings in which:

DESCRIPTION OF PREFERRED EMBODIMENTS

Figure 2:
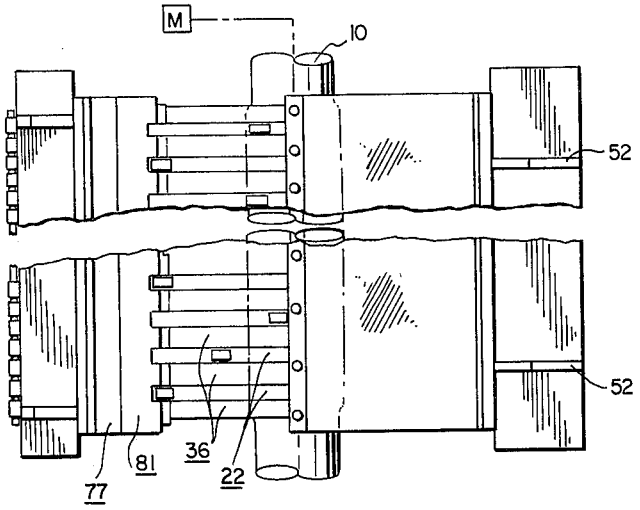
FIG. 2 is a top plan of the structure of FIG. 1 and is partially broken away and diagramatic form.
Figure 2A:
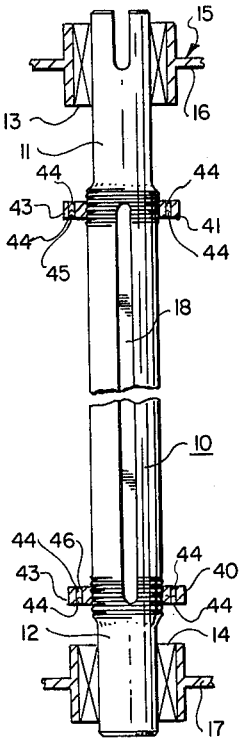
FIG. 2A is a fragmentary view of the shaft employed in the rotor of the shredder construction of FIGS. 1 and 2.
Figure 1:
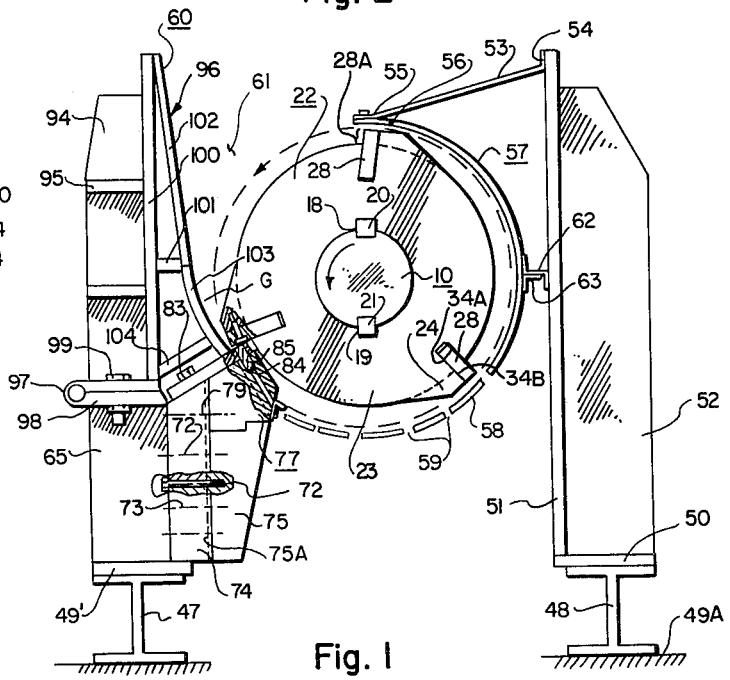
FIG. 1 is an end view, with the side support plate not shown, of a shredder construction showing a preferred embodiment of my new design.

In FIGS. 1, 2 and 2A a revolving shaft 10 is shown to be provided, the same having turned end portions 11 and 12 which fit into journal bearings 13 and 14, the latter being associated with fixed support structure 15 and, in particular, with end flanges 16 and 17 thereof. Shaft 10 includes a pair of opposite keyways 18 and 19 which receive respective keys 20 and 21 of each rotating bladeholder 22.

Figure 7:
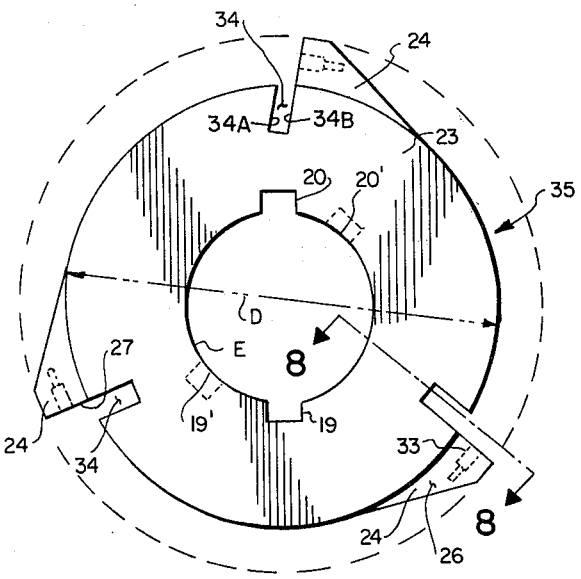
FIG. 7 is an elevation of a representation rotating bladeholder keyed to the shaft of the shredder herein.
Figure 8:
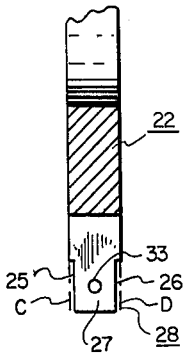
FIG. 8 is a fragmentary section taken along the line 8—8 in FIG. 7.
Figure 10:
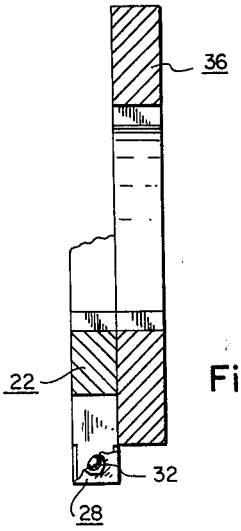
FIG. 10 is a section view similar to FIG. 9, but illustrates the bladeholder and spacer of a respective pair being contiguously disposed in the makeup of the shaft.
Figure 11:
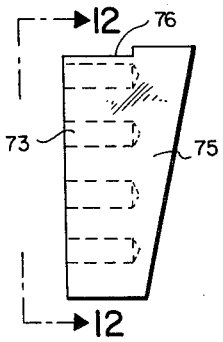
FIG. 11 is an enlarged detail of a support member employed to support in part the stationary blade support and stationary blade of the invention, as seen in FIG. 1.
Figure 12:
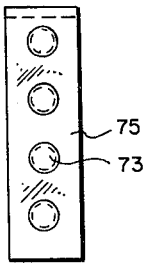
FIG. 12 is an end view taken along the line 12—12 in FIG. 11.
Figure 13:
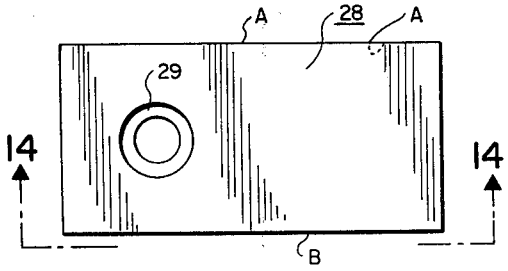
FIG. 13 is an enlarged top plan of a hardened steel, rotating blade designed for mounting and tightly fitting the slots of the individual bladeholders.
Figure 14:
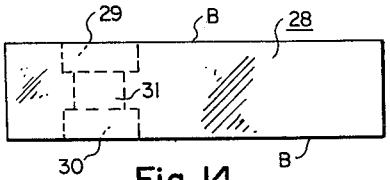
FIG. 14 is an edge view taken along the line 14—14 in FIG. 13.

Rotating bladeholder 22, see FIGS. 1, 2 and 7, has a disc-shaped body 23 provided with radially outwardly projecting projections of protuberances 24, in the embodiment shown in FIG. 7, three in number. These projections are recessed at opposite faces 25 and 26, see FIG. 8, and respectively provide a respective forwardly facing blade backing surface 27 for each of the rotating blades 28. Blades 28 have respective, work impact forward surfaces 28A and are illustrated in FIGS. 1, 13 and 14, and may be made reversible by way of having a pair of counter bores 29 and 30 joined by common bore 31. Accordingly, all four edges A and B, top and bottom, may be used as cutting or shearing edges. Bore 31 accommodates an elongate securement means such as a capscrew or other attachment 32 which threads into threaded aperture 33 of each of the projections 24 of rotating bladeholder 22. The phantom lines at C and D in FIG. 8 simply illustrates the opposite side contours of a respective rotating blade 28 when the same is emplaced as shown in FIG. 10 by way of example.

In the example shown, see FIG. 7, the bladeholder may have three or even another number of outward blade-seat portions comprising projections, protuberances or protrusions 24 accommodating the seated mounting of the respective rotating blades 28. It is important to note that, for added support, the inner ends of each blade are fitted into respective slots 34 which serve as seats 34 for such blades, the slots having opposed surfaces 34A and 34B engaging opposite sides of the respective blades.

Figure 9:
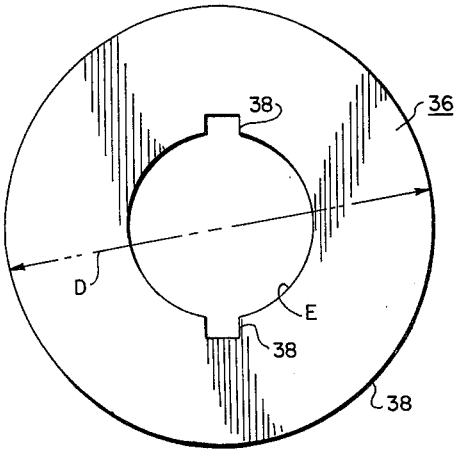
FIG. 9 is an elevation of a representative one of the spacers employed in the makeup of the shaft of FIG. 1.

As illustrated in FIG. 2, it is desirous that the rotating bladeholders with their individual blades are preferably set upon the shaft so the locus of corresponding blades of the progression of adjacent bladeholders form a helix about the axis of shaft 10. For this reason the individual bladeholders 22 of blade assemblies 35 will be slightly displaced, e.g. 30° apart by way of example, so that there is a progressive descent of the protrusions of the respective blades as the bladeholders revolve in a common direction about their common shaft 10. Accordingly, dotted lines 19′ and 20′ will indicate the keyway positions, for example, of a next adjacent rotating bladeholder 22. Spacers 36 in FIGS. 1, 9 and 10 are preferably of the same nominal diameter D as diameter D of the bladeholder in FIG. 7. Shaft apertures E are the same and are a few thousandths oversize relative to common shaft 10; these shaft aperture diameters E in FIGS. 7 and 9 relative to bladeholder 22 and spacer 36 can be identical. Since the spacers can be perfectly round at their respective peripheries 38, then these may be stamped or punched with keyways 38 and 39 in the same nominal position. Either separate keys can be used or simply elongate keys 20 and 21 employed or dispositioned completely through keyway slots 19 on opposite sides of shaft 10. Threaded portions 40 and 41, see FIG. 2, are provided the shaft to include takeup nuts 42 and 43 that are tightened down to make up the shaft assembly by compressing together the spacers and the individual rotating bladeholders. Double set screws 44 may be disposed through the nuts 43 at respective threaded apertures 45 and 46 for detering reverse rotation of the nuts once the spacers and bladeholders are locked together by such nuts. Depending upon the rotation of the shaft, the end portions are oppositely threaded at 40 and 41.

Figure 3:
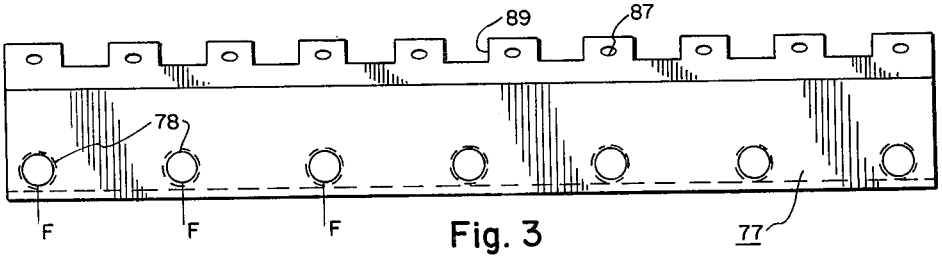
FIGS. 3 and 4 are rear side and end views, respectively, of the stationary blade support employed in the shredder construction.
Figure 4:
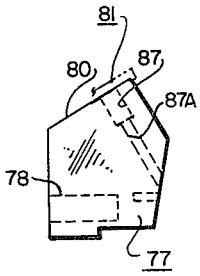
Figure 5:
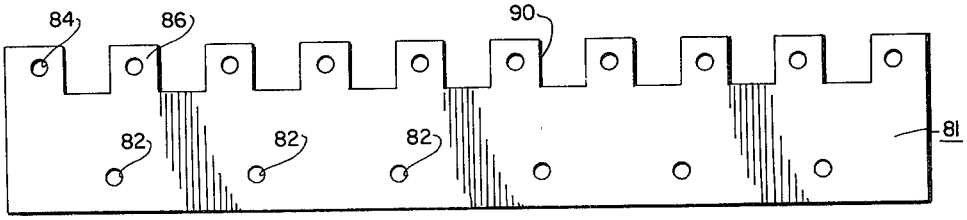
FIGS. 5 and 6 are a top plan, and end view, respectively, of the stationary blade employed and mounted to the stationary bladeholder of FIGS. 3 and 4.
Figure 6:
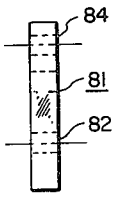

The made-up shaft is carried by journal bearings 14 disposed in the opposite end flanges 16 and 17 of a primary support structure 15. Such primary support structure 15, in addition to including the end flanges or end structure 16 and 17, likewise includes I beams 47 and 48 resting upon common ground plane 49. The I beams support pads 49′ and 50. Pad 50 in turn supports a side plate 51 to which a series of upright braces 52 are welded or otherwise secured. Crossplate 53 has its ends 54 and 55 secured to side plate 51 and also the upper margin 56 of curved plate 57. Curved plate 57 includes a screen extremity 58 provided with apertures 59 used for screening out desirably cut pieces of materials introduced into the hopper 60 at hopper area 61. Bracket 62 and support angle 63 are employed and are welded to the screen and side plate 51 and also are welded or otherwise secured together themselves, so as to support the curved plate 57. Pad 49 is shown to be welded to and support a series of horizontally spaced upstanding members 65 which themselves are welded to horizontal member 74 disposed parallel to shaft 10. Respective block 75 includes stepped upper shoulder 76 that seats stationary blade support 77, see FIG. 3. It is understood that a series of vertical, horizontally spaced, mutually parallel intermediate blocks 75 seat into vertical grooves 75A of fixed structure horizontal member 74 and are bolted in place by bolts 72, 73, this to provide the necessary support for stationary blade support 77 along mutually spaced points F. These points are defined by threaded apertures 78 accommodating mounting bolts 79 which mount blade support 77 to member 74.

Upper surface 80 of stationary blade support 77 serves as a firm base support for stationary blade 81. The latter includes a series of apertures 82 accommodating threaded attachment by capscrews 83 to horizontal member 74; additionally, apertures 84 provide for the attachment, by dowel pins 85, of the forward extensions 86 of the stationary blade to stationary blade support 77 at apertures 87. Apertures 87A are dowel-pin knock-out apertures.

Accordingly, it is seen that the structure at 74, 75 and 77 supports the elongate stationary blade at 81 so that the same may co-act with the individual rotating blades 28 which pass through slots 89 and 90 of stationary blade support 77 and stationary blade 81, respectively. The rotating blades and the stationary blade at 81 are preferably fabricated from tool-steel, and are preferably hardened after fabrication. Movable side structure 96 includes a series of upstanding supports or webs 94 and horizontal brace supports 95. These are fabricated together as the movable side structure 96 so that the same can be rotationally displaced, via the inclusion of hinge 97 associated with plate 98 of the lower structure. The side structure 96 is fixedly disposed by inclusion of attachments 99. Side 100 of side structure 96 includes a brace 101 which provides for the support of slanted hopper side 102 and its extension, curved side 103. The latter may be welded to brace 104 as desired to complete the structure. It is noted that the entire side structure 96 may be pivotally displaced to the left, by pivoting about hinge 97, so as to open up completely the madeup shaft for maintenance, rework, substitution, or for other purposes.

In assembly, the shaft is made up by its keys, the several rotating bladeholders, with installed blades and spacers at 36. Closure of the hopper is achieved by bringing side structure 96 to erect position and by maintaining such position through the installation and tightening of attachments 99. The shaft is rotated by applying power at prime mover M so that the shaft revolves in the direction shown by the arrow in FIG. 1. Accordingly, there is a progressive cutting or shearing of materials introduced into the hopper at 61 by the downward movement of the rotating blades against the stationary blade 81. Pieces of the cut material such as tires to be shredded, and which are of reduced size will pass through the screen 58, whereas oversized materials will be returned via the revolving blades back to the hopper area so that these may progress again through the cutting area at G.

It is most important to note that, with the projections 24 being relieved or recessed at opposite sides, by way of example, then relief is had underneath the hardened rotating blades 28, thereby reducing frictional forces. Yet, the spacers 36 lap the interior extremities of the rotating blades in place within their respective rotating bladeholders, thereby adding rigidity to the blade mountings and preventing the same from experiencing transverse loadings during material impact periods.

Thus, no complicated machining of the shaft is required to provide sockets for the individual blades; rather, there is provided a locking of the interior half, essentially, of each blade by the slot at 34 in FIG. 7 and also by the spacers 36 which planarly ovelap such slots.

What is provided therefore is a new and improved shredder structure for accomplishing a number of objectives including secondary shredding. The machine is highly reliable in that the individual rotating blades are positively locked in position by the slots into which they are seated and by the spacers surface-contacting such blades. Yet the shaft can be easily reworked and/or replaced, and indeed the individual blades can be replaced, rotated end for end or simply reversed to provide new cutting edges facing downwardly toward the stationary blade.

The invention uniquely adds the baffle plate 53 for directing incoming feed solely into area 61; screen 58 may be anchored to the angle provided member 77, if desired. Thus, not only the shredder but the individual components and sub-combinations are important per se.

While particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

I claim:

1. For mounting to a revolving shaft, a blade-holder with a radially outwardly projecting protuberance having a forwardly-facing blade-backing surface and also provided with a slot proximate said blade-backing surface, said slot having opposed surfaces, a blade seated in said slot, engaging said opposed surfaces and disposed against said blade-backing surface, said blade having a work-impact forward surface positioned above said slot, and elongate securement means disposed above and outside said slot and projecting through said blade, above and over said slot, and into said protuberance.

2. The structure of claim 1 wherein said bladeholder is provided with a central aperture provided with a keyway.

3. The structure of claim 1 wherein said bladeholder has a disc-shaped body, said protuberance having opposite surfaces recessed relative to said disc-shaped body.

4. The structure of claim 3 wherein said blade is nominally of the same thickness as said disc-shaped body and overlaps on opposite sides of said protuberance.

5. The structure of claim 1 wherein said protuberance is provided with a threaded aperture, said blade having a counterbored aperture, said blade being provided with attachment means, as said elongate securement means, shouldered against and passing through said counterbored aperture and threaded into said protuberance aperture.

6. For mounting to a revolving shaft; a bladeholder having plural, mutually spaced, outwardly projecting, blade-seat portions and closed-ended threaded apertures depending therefrom, said bladeholder being provided with inwardly directed slots proximate said blade-seat portions, respectively, plural blades respectively seated in said slots and resting againt said portions, respectively, and threaded attachment means disposed outside of said slots for respectively securing said blades to and against said blade seat portions, said attachment means having accessible heads respectively recessed in said blades and threaded in said apertures.

7. The structure of claim 6 wherein said blades are nominally the same thickness as said bladeholder, said blade-seat portions being recessed on opposite sides whereby said blades at its opposite sides overlap said bladeholder.

8. In combination, a revolable shaft; plural, parallel, mutually-spaced bladeholders secured to said shaft for revolvement therewith; plural spacers respectively interposed between adjacent ones of said bladeholders, each of said bladeholders having at least one slot in part formed by a blade-seat projection, said projection projecting beyond the periphery of a respective adjacent spacer, said bladeholders each being provided with at least one blade seated within a respective slot and nestled between and against adjacent spacer and means for securing said blade against said projection,respectively; and means for securing together said spacers and bladeholders.

9. The structure of claim 8 wherein, as to each bladeholder said projection thereof is recessed beneath opposite sides of said blade thereof.

* * * * *